US009298131B1

(12) United States Patent
Matsumoto et al.

(10) Patent No.: US 9,298,131 B1
(45) Date of Patent: Mar. 29, 2016

(54) IMAGE FORMING APPARATUS

(71) Applicant: FUJI XEROX CO., LTD., Tokyo (JP)

(72) Inventors: Takuji Matsumoto, Kanagawa (JP); Kenichi Shimada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/796,158

(22) Filed: Jul. 10, 2015

(30) Foreign Application Priority Data

Jan. 28, 2015 (JP) ..... 2015-014248

(51) Int. Cl.
*G03G 15/08* (2006.01)

(52) U.S. Cl.
CPC ..... *G03G 15/0865* (2013.01)

(58) Field of Classification Search
CPC ..... G03G 15/0865
USPC ..... 399/258, 223, 224
See application file for complete search history.

(56) References Cited

U.S. PATENT DOCUMENTS 7,496,320 B2 * 2/2009 Kimura ..... G03G 15/0879 399/258
7,835,674 B2 * 11/2010 Woo ..... B65D 88/68 399/258
7,873,305 B2 * 1/2011 Moon ..... G03G 15/0896 399/258
7,929,885 B2 4/2011 Sakuma
8,086,147 B2 * 12/2011 Furuta ..... G03G 15/0865 399/258
8,126,374 B2 * 2/2012 Lee ..... G03G 15/0839 399/258
8,355,656 B2 * 1/2013 Okamoto ..... G03G 15/08 399/258
2004/0052538 A1 * 3/2004 Yugeta ..... G03G 15/0865 399/258
2005/0281591 A1 * 12/2005 Kitozaki ..... G03G 15/16 399/258

FOREIGN PATENT DOCUMENTS

JP 08-115042 A 5/1996
JP 2003-107885 A 4/2003
JP 2009-156993 A 7/2009

* cited by examiner

*Primary Examiner* — Susan Lee
(74) *Attorney, Agent, or Firm* — Sughrue Mion, PLLC

(57) ABSTRACT

An image forming apparatus includes plural developing devices, plural developer containers, and plural developer transport devices. The plural developing devices are arranged side-by-side in a first direction. The plural developer containers contain developer and have discharge ports disposed between the plural developing devices in the first direction. The plural developer transport devices transport the developer from the plural developer containers to the plural developing devices. The plural developer transport devices include respective transport portions arranged side-by-side. Through at least one of the transport portions, the developer is transported from a corresponding one of the discharge ports in a direction opposite to a direction in which the developer is transported from the other discharge ports through the other transport portions.

9 Claims, 8 Drawing Sheets

IMAGE FORMING APPARATUS

CROSS-REFERENCE TO RELATED APPLICATIONS

This application is based on and claims priority under 35 USC 119 from Japanese Patent Application No. 2015-014248 filed Jan. 28, 2015.

BACKGROUND

Technical Field

The present invention relates to an image forming apparatus.

SUMMARY

According to an aspect of the present invention, an image forming apparatus includes plural developing devices, plural developer containers, and plural developer transport devices. The plural developing devices are arranged side-by-side in a first direction. The plural developer containers contain developer and have discharge ports disposed between the plural developing devices in the first direction. The plural developer transport devices transport the developer from the plural developer containers to the plural developing devices. The plural developer transport devices include respective transport portions arranged side-by-side. Through at least one of the transport portions, the developer is transported from a corresponding one of the discharge ports in a direction opposite to a direction in which the developer is transported from the other discharge ports through the other transport portions.

BRIEF DESCRIPTION OF THE DRAWINGS

Exemplary embodiment of the present invention will be described in detail based on the following figures, wherein.

DETAILED DESCRIPTION

Exemplary Embodiment

Figure 1:
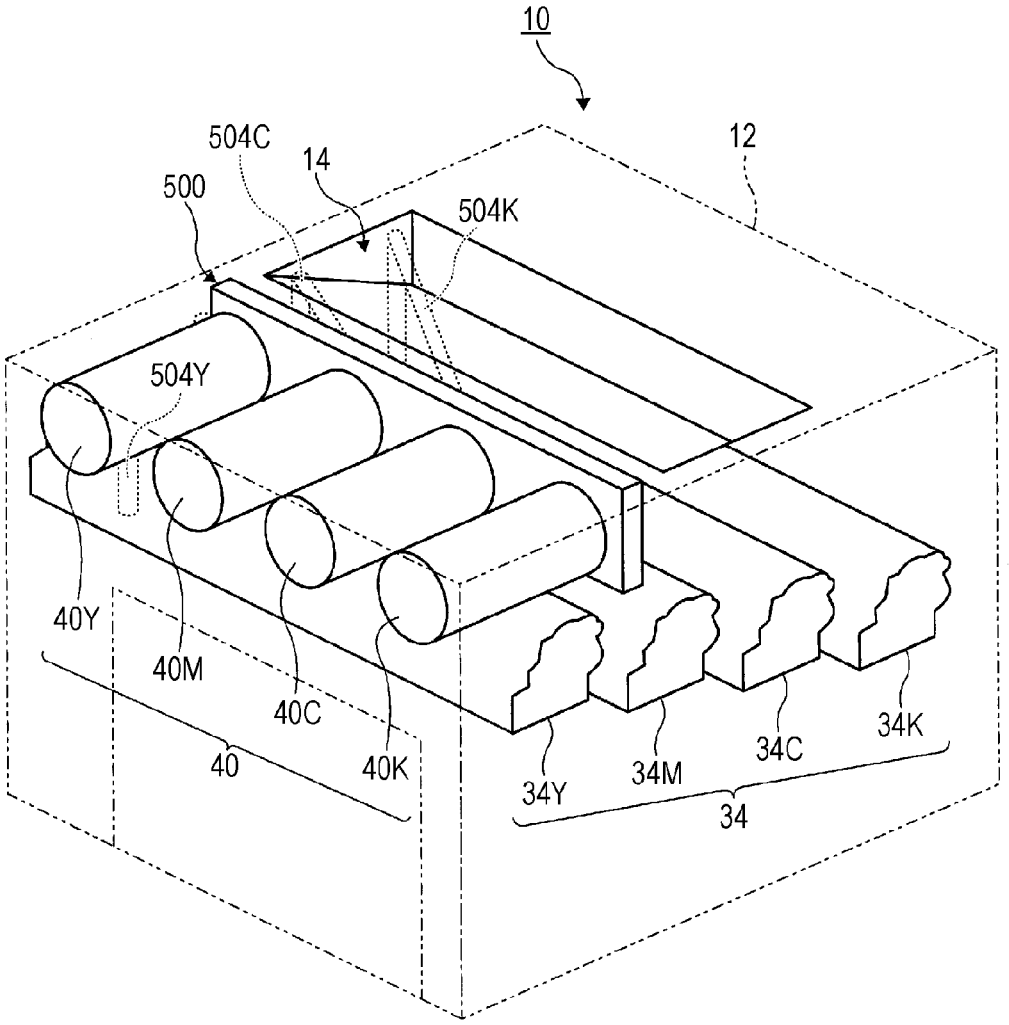
FIG. 1 is a partially see-through perspective view of an image forming apparatus according to an exemplary embodiment.

An image forming apparatus according to an exemplary embodiment is described with reference to FIGS. 1 to 8B. An image forming apparatus 10 according to the exemplary embodiment includes four image forming sections 22Y, 22M, 22C, and 22K, a transfer device 50, four developer containers 40Y, 40M, 40C, and 40K, a developer container attachment device 500, four developer transport devices 504Y, 504M, 504C, and 504K, a sheet feeding device 100, and a fixing unit 200. The image forming sections 22Y, 22M, 22C, and 22K respectively include developing devices 34Y, 34M, 34C, and 34K. The developer containers 40Y, 40M, 40C, and 40K respectively contain yellow, magenta, cyan, and black developers. The developer containers 40Y, 40M, 40C, and 40K are attached to the developer container attachment device 500. The developer transport devices 504Y, 504M, 504C, and 504K transport the developers contained in the developer containers 40Y, 40M, 40C, and 40K to the respective image forming sections 22Y, 22M, 22C, and 22K. Furthermore, a recording medium transport path 400 used to transport recording media 16 is formed in the image forming apparatus 10. An output unit 14 is provided in an upper portion of the image forming apparatus 10. The recording media 16 on which images have been formed are output to the output unit 14. The developer containers 40Y, 40M, 40C, and 40K may be collectively referred to as developer containers 40. Also, the image forming sections 22Y, 22M, 22C, and 22K may be collectively referred to as image forming sections 22. Also, the developer transport devices 504Y, 504M, 504C, and 504K may be collectively referred to as developer transport devices 504.

Figure 2:
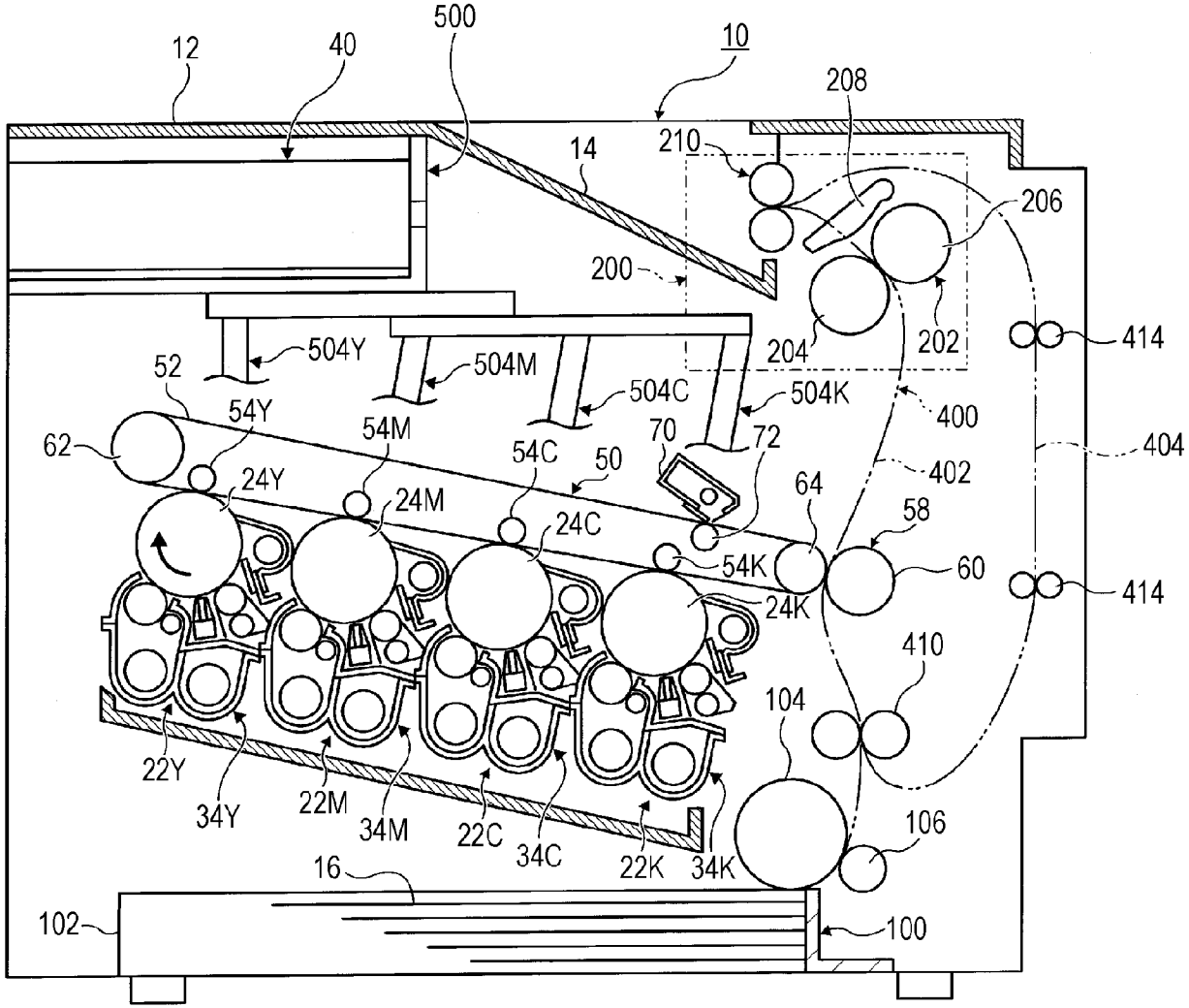
FIG. 2 is a side sectional view of the image forming apparatus according to the exemplary embodiment.

As illustrated in FIGS. 1 and 2, the developer containers 40Y, 40M, 40C, and 40K attached to the developer container attachment device 500 are arranged parallel to one another so that the longitudinal direction thereof extends in a direction (first direction) perpendicular to the recording medium transport path 400 for the recording media 16 and the image forming sections 22Y, 22M, 22C, and 22K in the image forming apparatus 10 according to the exemplary embodiment. Furthermore, the developer transport devices 504Y, 504M, 504C, and 504K are provided so that the developers discharged from the respective developer containers 40Y, 40M, 40C, and 40K are transported above the respective image forming sections 22Y, 22M, 22C, and 22K, and then drop downward so as to be supplied to the respective image forming sections 22Y, 22M, 22C, and 22K.

The image forming sections 22Y, 22M, 22C, and 22K respectively include image holding bodies 24Y, 24M, 24C, and 24K and respectively form yellow, magenta, cyan, and black developer images with the respective yellow, magenta, cyan, and black developers. The image forming sections 22 are arranged in the following order from a side furthest from the recording medium transport path 400, through which the recording media 16 are transported, in an image forming apparatus body 12: the image forming section 22Y for yellow, the image forming section 22M for magenta, the image forming section 22C for cyan, and the image forming section 22K for black.

The four developer containers 40Y, 40M, 40C, and 40K respectively contain the yellow, magenta, cyan, and black developers. These developer containers 40Y, 40M, 40C, and 40K are attached to the developer container attachment device 500 provided in the image forming apparatus body 12. The developer containers 40Y, 40M, 40C, and 40K are connected to developer container connecting units 502 provided in the developer container attachment device 500.

The developers contained in the developer containers 40Y, 40M, 40C, and 40K are supplied to the respective developing devices 34Y, 34M, 34C, and 34K by the respective developer transport devices 504Y, 504M, 504C, and 504K. The developer containers 40Y, 40M, 40C, and 40K according to the exemplary embodiment are attached to the developer container attachment device 500 so as to be arranged side-by-side in this order from the back side of the page of FIG. 1.

Figure 3A:
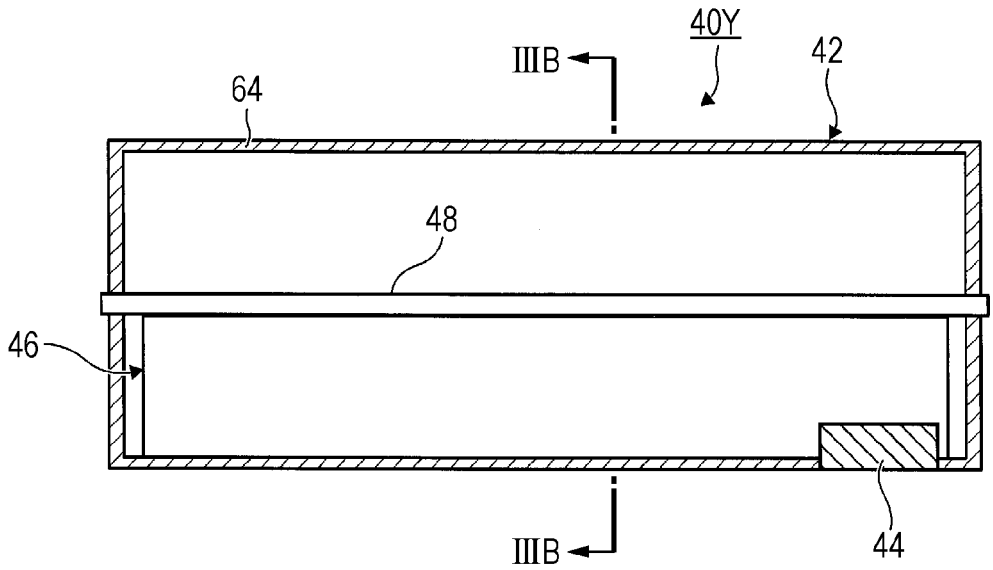
FIG. 3A is a sectional view of a developer container.
Figure 3B:
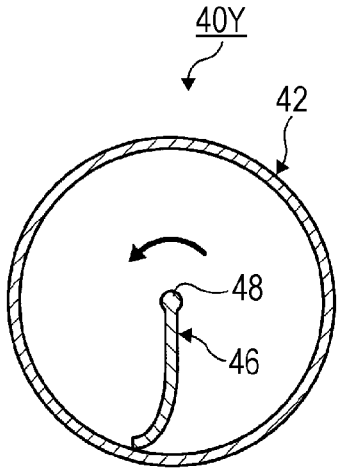
FIG. 3B is a sectional view of the developer container taken along line IIIB-IIIB of FIG. 3A.

Next, the developer containers are described with reference to FIGS. 3A and 3B. Since the structures of the four developer containers 40Y, 40M, 40C, and 40K are the same, the developer container 40Y is described as a representative example of the developer containers 40Y, 40M, 40C, and 40K. The developer container 40Y has, for example, a cylindrical external shape and includes a developer supply unit 42 therein. An agitating member 46 is provided in the developer supply unit 42 of the developer container 40Y in the axial direction. A rotational shaft 48 included in the agitating member 46 is rotatably supported on both sides of the developer container 40Y. Furthermore, near one end of the developer container 40Y, for example, on a rear side in a direction in which the developer container 40Y is inserted into the image forming apparatus body 12, a discharge port 44 through which the developer contained in the developer container 40Y is discharged is formed. When the rotational shaft 48 of the agitating member 46 receives a drive force from a drive unit 501 (see FIG. 5), the agitating member 46 is rotated counterclockwise as indicated by an arrow of FIG. 3B. This agitates the developer and moves the developer toward the discharge port 44, so that the developer is supplied to the developer transport device 504Y (see FIG. 7B). The discharge ports 44 of the developer containers 40Y, 40M, 40C, and 40K are each disposed between the plural developing devices 34.

Next, the image forming sections 22Y, 22M, 22C, and 22K are described in detail with reference to FIG. 4. Although the colors of the developers used in the image forming sections 22Y, 22M, 22C, and 22K are different from one another, the image forming sections 22Y, 22M, 22C, and 22K have a common structure. Thus, the image forming section 22Y for yellow is described as a representative example of the image forming sections 22.

Figure 4:
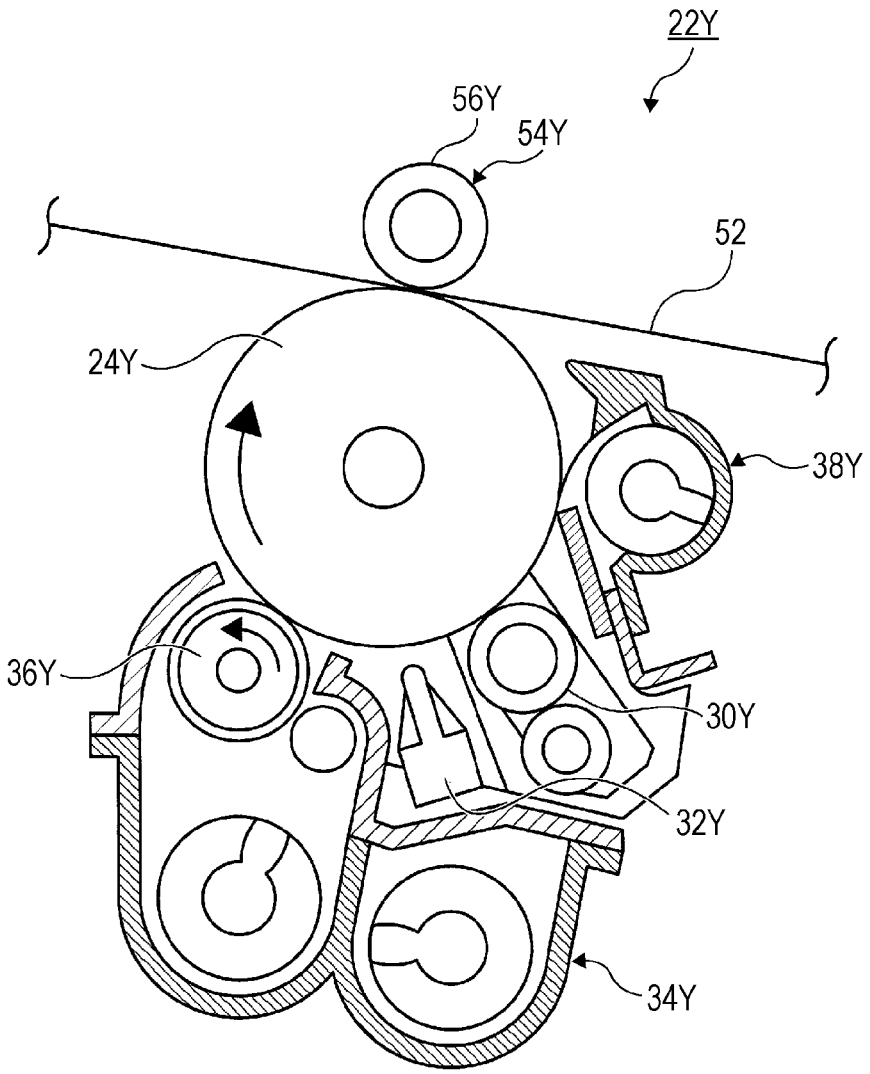
FIG. 4 is a side sectional view of an image forming section according to the exemplary embodiment.

As illustrated in FIG. 4, the image forming section 22Y includes the image holding body 24Y, a charging device 30Y, a latent image forming device 32Y, the developing device 34Y, and an image-holding-body cleaning device 38Y. The charging device 30Y includes, for example, a charging roller and uniformly charges a surface of the image holding body 24Y. As the latent image forming device 32Y, for example, an LED array is used. The latent image forming device 32Y radiates light to the surface of the image holding body 24Y uniformly charged by the charging device 30Y, thereby forming a latent image on the surface of the image holding body 24Y.

The developing device 34Y includes a developing roller 36Y used as a developer holding body. The developing roller 36Y supplies the yellow developer to the image holding body 24Y so as to develop the latent image formed on the surface of the image holding body 24Y with the yellow developer. The image-holding-body cleaning device 38Y includes, for example, a plate-shaped cleaning member. The yellow developer remaining on the surface of the image holding body 24Y after a yellow developer image has been transferred onto an intermediate transfer body 52 is scraped off from the image holding body 24Y by the cleaning member. Thus, the image holding body 24Y is cleaned.

The yellow developer is supplied to the developing device 34Y from a side connected to a developing device connecting unit 524Y provided in the developer container attachment device 500. An end of the developer transport device 504Y is connected to this developing device connecting unit 524Y, so that the yellow developer is transported from the developer container 40Y to the developing device connecting unit 524Y to be supplied to the developing device 34Y.

Figure 5:
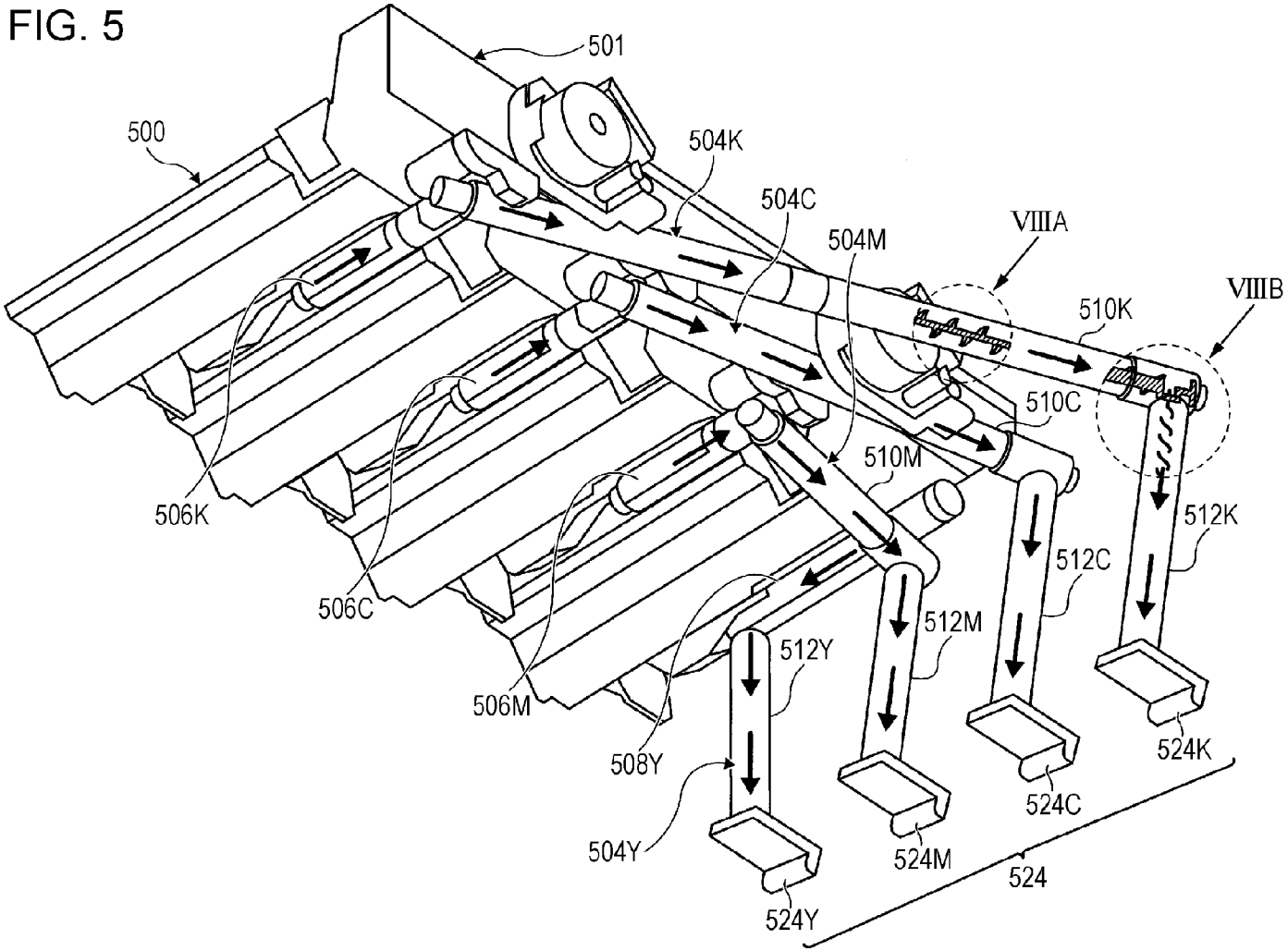
FIG. 5 is a perspective view of developer transport devices according to the exemplary embodiment.

According to the exemplary embodiment, the developing device connecting units 524Y, 524M, 524C, and 524K, through which the respective developers are supplied to the developing devices 34Y, 34M, 34C, and 34K, are disposed on a single side that is the same side as the side where the developer container 40Y for yellow is disposed in the image forming apparatus body 12 (see FIGS. 1 and 5). The developing device connecting units 524Y, 524M, 524C, and 524K may be collectively referred to as developing device connecting units 524.

The transfer device 50 includes the intermediate transfer body 52, first transfer devices 54Y, 54M, 54C, and 54K, and a second transfer device 58. The intermediate transfer body 52 is used as a transport member that holds and transports the developers. According to the exemplary embodiment, the intermediate transfer body 52 has an endless belt shape and is rotatably supported by plural support rollers 62 and 64.

At least one of the plural support rollers 62 and 64 is used as a drive roller that transmits drive to the intermediate transfer body 52. The drive is transmitted from a drive source (not illustrated), which is, for example, a motor or the like, to the drive roller through a drive transmitting mechanism (not illustrated) or the like. The drive roller is rotated by the transmitted drive, thereby rotating the intermediate transfer body 52. According to the exemplary embodiment, the support roller 64 is used as a drive transmitting roller. Furthermore, at least one of the plural support rollers 62 and 64 is used as a tension roller that applies tension to the intermediate transfer body 52. According to the exemplary embodiment, the support roller 62 is used as the tension roller.

The first transfer devices 54Y, 54M, 54C, and 54K include respective first transfer rollers 56Y, 56M, 56C, and 56K (see FIG. 4). A first transfer bias is applied to each of the first transfer rollers 56Y, 56M, 56C, and 56K. Thus, the developer images formed on the surfaces of the image holding bodies 24Y, 24M, 24C, and 24K are transferred onto the intermediate transfer body 52.

The second transfer device 58 includes a second transfer roller 60 and is used as a transfer device that transfers the developers held by the intermediate transfer body 52 to each of the recording media 16.

An intermediate-transfer-body cleaning device 70 is used as a cleaning device that removes the developers from the surface of the intermediate transfer body 52. In a movement direction (rotational direction) of the intermediate transfer body 52, the intermediate-transfer-body cleaning device 70 is disposed downstream of the second transfer device 58 and upstream of the first transfer device 54Y, which is deposed at the most upstream position among the first transfer devices 54Y, 54M, 54C, and 54K. A backup roller 72, which is part of the intermediate-transfer-body cleaning device 70, is provided inside the intermediate transfer body 52.

The sheet feeding device 100 contains the recording media 16 stacked therein. The sheet feeding device 100 includes, for example, a single recording medium container 102, a feed roller 104, and a retard roller 106. The feed roller 104 feeds each of the recording media 16 contained in the recording medium container 102. The retard roller 106 is used to prevent each of the recording media 16 from being fed while being superposed on another recording medium.

The fixing unit 200 is detachably attached to the image forming apparatus body 12 of the image forming apparatus 10. The fixing unit 200 according to the exemplary embodiment includes a fixing device 202 and an output device 210 which is integrated with the fixing device 202.

The fixing device 202 includes a heating roller 204 that heats each of the recording media 16 and the pressure roller 206 that presses the recording medium 16 against the heating roller 204.

The output device 210 is rotatable in a direction in which the recording medium 16 is output to the output unit 14 and in a direction in which the recording medium 16 is transported from the output unit 14 side to a recording medium inversion transport sub-path 404, which will be described later.

A guide member 208 that guides the recording medium 16 is provided between the fixing device 202 and the output device 210. The guide member 208 is movable between a position in which the guide member 208 guides the recording medium 16 from the fixing device 202 toward the output device 210 and a position in which the guide member 208 guides the recording medium 16 from the output device 210 toward the recording medium inversion transport sub-path 404.

The recording medium transport path 400 has a recording medium transport sub-path 402 and the recording medium inversion transport sub-path 404. The recording medium 16 is transported from the sheet feeding device 100 toward the second transfer device 58 and output from the second transfer device 58 to the output unit 14 through the recording medium transport sub-path 402. The sheet feeding device 100, a registration roller 410, the second transfer device 58, and the fixing unit 200 are provided in this order from an upstream side in a recording medium transport direction along the recording medium transport sub-path 402.

The registration roller 410 temporarily stops a movement toward the second transfer device 58 side of a leading end portion of the recording medium 16 being transported toward the second transfer device 58 and then restarts the movement toward the second transfer device 58 of the leading end portion of the recording medium 16 at timing matching to timing when part of the intermediate transfer body 52 where developer images have been transferred reaches the position of the second transfer device 58.

The recording medium inversion transport sub-path 404 is used to invert the recording medium 16 on one side of which an image has been formed and transports the recording medium 16 from the output device 210 to an upstream side of the registration roller 410. For example, two inversion transport rollers 414 are provided along the recording medium inversion transport sub-path 404.

In order to form an image on the other side of the recording medium 16 on the one side of which the image has been formed, an advancing direction of the recording medium 16 on the one side of which the image has been formed is reversed by the output device 210 while a trailing end portion of the recording medium 16 is in contact with the output device 210. Thus, the recording medium 16 is guided, the trailing end first, to the recording medium inversion transport sub-path 404, so that the recording medium 16 is transported to the registration roller 410.

As illustrated in FIGS. 1, 2, 5, and 6, the developer transport devices 504Y, 504M, 504C, and 504K are provided between a side where the output unit 14 for the recording medium 16 is disposed and the developing devices 34Y, 34M, 34C, and 34K in the image forming apparatus body 12. Furthermore, the developing device connecting units 524Y, 524M, 524C, and 524K are provided at portions where the developer transport devices 504Y, 504M, 504C, and 504K are connected to the respective developing devices 34Y, 34M, 34C, and 34K. The developer container connecting units 502 of the developer container attachment device 500 are each provided on a rear side of a corresponding one of the developer containers 40 to which the developer container connecting unit 502 is attached. The drive unit 501 that drives the agitating member 46 of the developer containers 40Y, 40M, 40C, and 40K is provided on the developer container connecting unit 502 side.

The developer containers 40Y, 40M, 40C, and 40K for the colors according to the exemplary embodiment are attached to the developer container attachment device 500 such that the developer containers 40Y, 40M, 40C, and 40K are arranged side-by-side in the following order from the rear side when the image forming apparatus body 12 of FIG. 1 is seen in plan view: that is, the developer containers 40Y, 40M, 40C, and 40K for yellow, magenta, cyan and black. The developing devices 34Y, 34M, 34C, and 34K are arranged from a side furthest from the recording medium transport path 400 in the following order: that is, the developing devices 34Y for yellow, 34M for magenta, 34C for cyan, and 34K for black. Furthermore, the developing device connecting units 524Y, 524M, 524C, and 524K, through which the developers are supplied to the developing devices 34Y, 34M, 34C, and 34K, are disposed on a single side. According to the exemplary embodiment, the developing device connecting units 524Y, 524M, 524C, and 524K are disposed on the same side as the side where the developer container 40Y for yellow is disposed.

The developer transport devices are described with reference to FIGS. 5 to 8B. The structures of the developer transport devices 504Y, 504M, 504C, and 504K according to the exemplary embodiment are different from one another in accordance with the positions where the developer containers 40Y, 40M, 40C, and 40K are attached to the developer container attachment device 500. As illustrated in FIG. 5, regarding these structures, a transport direction in the developer transport devices 504M, 504C, and 504K just after the developers have been supplied from the developer containers 40M for magenta, 40C for cyan, and 40K for black is different from a transport direction in the developer transport device 504Y just after the developer has been supplied from the developer container 40Y for yellow. Specifically, in the developer transport devices 504M, 504C, and 504K for magenta, cyan, and black, the developers are transported in the longitudinal direction of the developer containers 40, and more specifically, the developers are transported in a direction in which the developer containers 40 are inserted so as to be attached to the developer container attachment device 500, that is, a direction toward the output unit 14 side of the image forming apparatus body 12. In the developer transport device 504Y for yellow, the developer is transported in the longitudinal direction of the developer containers 40, and more specifically, the developer is transported in a direction opposite to the direction in which the developer containers 40 are inserted so as to be attached to the developer container attachment device 500, that is, a direction opposite to the direction toward the output unit 14 side of the image forming apparatus body 12. Thus, the transport direction of the yellow developer is opposite to the transport direction of the magenta, cyan, and black developers.

Initially, the developer transport device 504K that transports the black developer is described. The developer transport device 504K for black includes a transport portion 506K, an intermediate transport portion 510K, and a downward transport portion 512K. The developer that has just been discharged through the discharge port 44 of the developer container 40K for black is transported through the transport portion 506K. The intermediate transport portion 510K is connected to the transport portion 506K. The downward transport portion 512K is connected to the intermediate transport portion 510K. The developing device connecting unit 524K connected to the developing device 34K is provided at a lower end of the downward transport portion 512K.

Figure 7A:
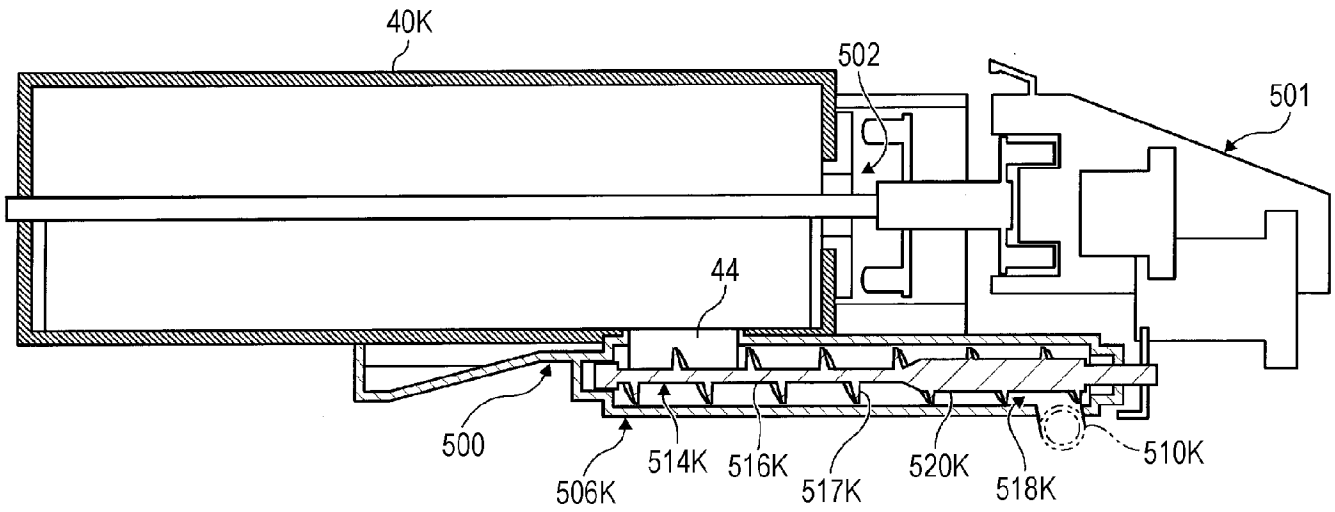
FIG. 7A is a side sectional view of a developer container for black and part of a developer transport device for black.

As illustrated in FIG. 7A, the transport portion 506K is a hollow cylindrical body provided in the longitudinal direction of the developer container 40K for black. A transport member 514K that transports the developer is provided in the transport portion 506K. The transport member 514K includes a rotational shaft portion 516K and a transport body 517K. The rotational shaft portion 516K is provided in the longitudinal direction of the cylindrical body. The transport body 517K is formed of a wall body helically projecting in the radial directions of this rotational shaft portion 516K. When the transport member 514K is rotated, the developer is transported by the helical transport body 517K in the direction in which the developer containers 40 are inserted for attachment, that is, toward the output unit 14 side of the image forming apparatus body 12.

Also, a transport amount adjustment portion 518K is provided in the transport portion 506K. The diameter of a rotational shaft portion 520K of the transport member 514K is increased compared to that of the other part of the rotational shaft portion 516K in the transport amount adjustment portion 518K. Thus, a space in which the developer is transported is reduced in the transport amount adjustment portion 518K. This limits the amount of the developer to be transported by the transport member 514K, thereby adjusting the amount of the developer to be transported.

Figure 6:
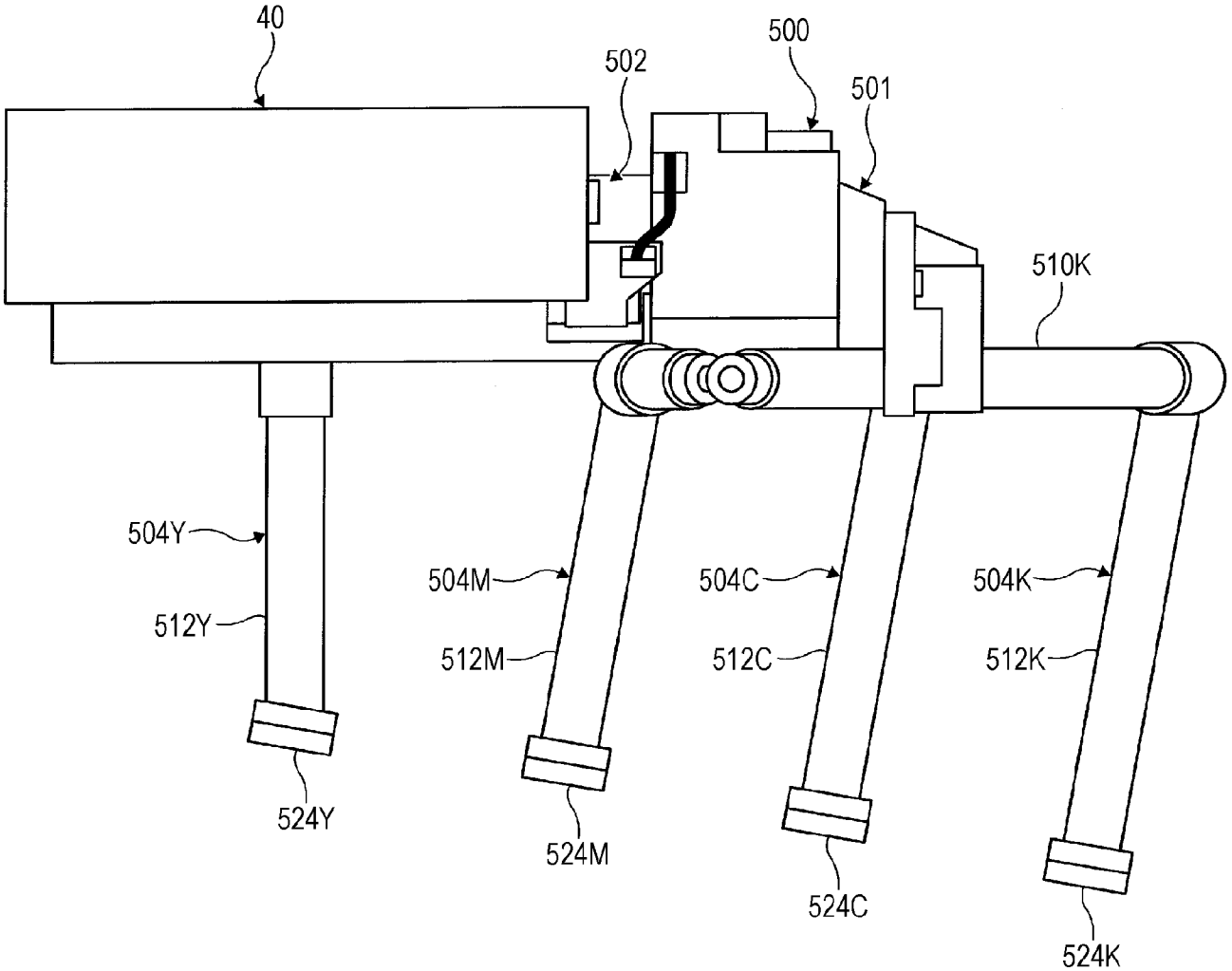
FIG. 6 is a side view of the developer transport devices according to the exemplary embodiment seen in one direction.

After the developer has been transported through the transport portion 506K, the developer is moved to the intermediate transport portion 510K. The transport portion 506K is connected to the downward transport portion 512K through the intermediate transport portion 510K. The intermediate transport portion 510K is disposed between the developer container 40K and the developing device 34K in the image forming apparatus body 12. As illustrated in FIG. 6, the intermediate transport portion 510K substantially horizontally extends in the image forming apparatus body 12 according to the exemplary embodiment.

Figure 8A:
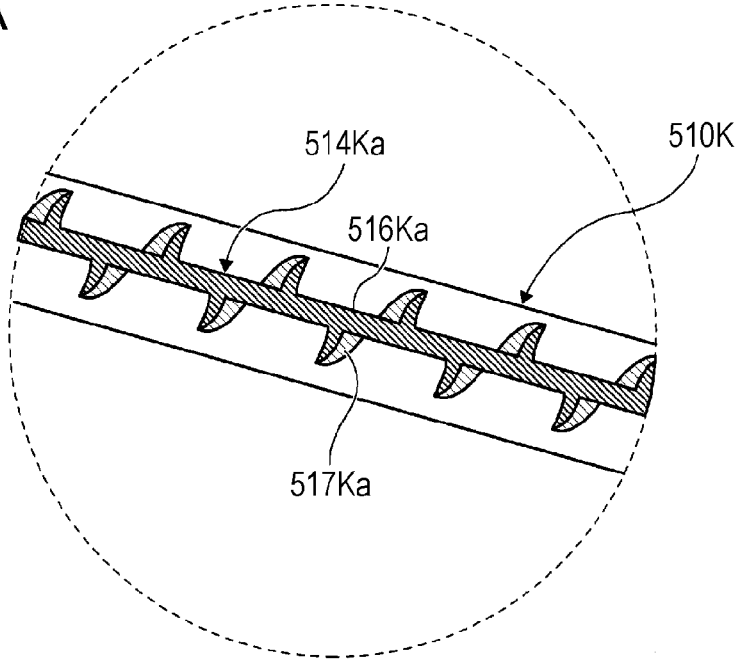
FIG. 8A is an enlarged sectional view of part VIIIA of FIG. 5.

As illustrated in FIGS. 5 and 8A, the intermediate transport portion 510K is a hollow cylindrical body having such a length that the intermediate transport portion 510K connects the transport portion 506K to the downward transport portion 512K. A transport member 514Ka is provided in the intermediate transport portion 510K. The transport member 514Ka has substantially the same structure as that of the transport portion 506K and includes a long rotational shaft portion 516Ka and a transport body 517Ka. The rotational shaft portion 516Ka is provided in the longitudinal direction of the cylindrical body. The transport body 517Ka is formed of a wall body helically projecting in the radial directions of this rotational shaft portion 516Ka. When the transport member 514Ka is rotated, the developer is transported from the transport portion 506K side toward the downward transport portion 512K by the helical transport body 517Ka.

After the developer has been transported through the intermediate transport portion 510K, the developer is moved to the downward transport portion 512K. The downward transport portion 512K is a hollow cylindrical body and connects the intermediate transport portion 510K to the developing device 34K. As illustrated in FIGS. 5 and 6, the downward transport portion 512K according to the exemplary embodiment is provided so as to be vertically oriented on one end portion side of the image forming apparatus body 12 where the developer container 40Y for yellow is disposed. That is, transportation of the developer through the downward transport portion 512K is performed by dropping of the developer from a top portion of the downward transport portion 512K on the intermediate transport portion 510K side. Furthermore, as illustrated in FIG. 6, the downward transport portion 512K is slightly inclined.

Figure 8B:
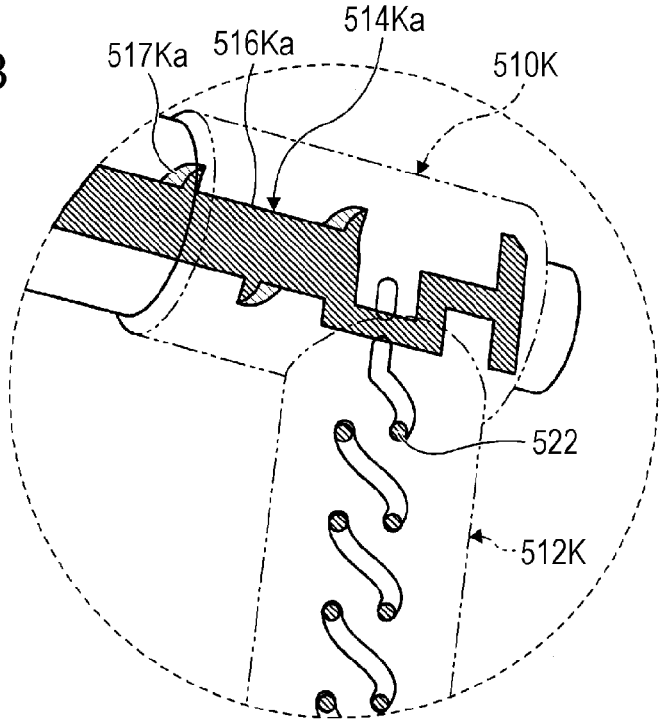
FIG. 8B is an enlarged sectional view of part VIIIB of FIG. 5.

As illustrated in FIG. 8B, a crumbling member 522 is provided in the downward transport portion 512K. The crumbling member 522 is brought into contact with the developer, thereby crumbling the developer. The crumbling member 522 is obtained by forming a long thin rod-shaped body to have a helical shape and has a portion having, for example, a crampon or hook shape so that an end portion of the crumbling member 522 on the intermediate transport portion 510K side is hooked onto the rotational shaft portion 516K. Furthermore, a portion of the rotational shaft portion 516K of the intermediate transport portion 510K onto which the crumbling member 522 is hooked is formed at a position shifted from the axis of the rotational shaft portion 516K, so that a so-called crank shape is formed. Thus, by rotating the rotational shaft portion 516K of the intermediate transport portion 510K, the crumbling member 522 hooked on the rotational shaft portion 516K is repeatedly moved up and down. This causes the crumbling member 522 to be brought into contact with the developer, thereby crumbling the developer.

After the developer has been transported through the downward transport portion 512K, the developer is moved into the developing device 34K. This allows development to be performed by the image forming section 22K as described above.

Next, the developer transport device 504M that transports the magenta developer is described. As illustrated in FIGS. 5 and 6, the developer transport device 504M for magenta includes a transport portion 506M, an intermediate transport portion 510M, and a downward transport portion 512M. The developer that has just been discharged through the discharge port 44 of the developer container 40M for magenta is transported through the transport portion 506M. The intermediate transport portion 510M is connected to the transport portion 506M. The downward transport portion 512M is connected to the intermediate transport portion 510M. The developing device connecting unit 524M connected to the developing device 34M is provided at a lower end of the downward transport portion 512M. Regarding the structure of the developer transport device 504M for magenta, the length of the intermediate transport portion 510M is less than that of the developer transport device 504K for black, and the downward transport portion 512M is arranged side-by-side with the downward transport portion 512K for black. Since other structures of the developer transport device 504M are in common with those of the developer transport device 504K, detailed description thereof is omitted.

Next, the developer transport device 504C that transports the cyan developer is described. As illustrated in FIGS. 5 and 6, the developer transport device 504C for cyan includes a transport portion 506C, an intermediate transport portion 510C, and a downward transport portion 512C. The developer that has just been discharged through the discharge port 44 of the developer container 40C for cyan is transported through the transport portion 506C. The intermediate transport portion 510C is connected to the transport portion 506C. The downward transport portion 512C is connected to the intermediate transport portion 510C. The developing device connecting unit 524C connected to the developing device 34C is provided at a lower end of the downward transport portion 512C. Regarding the structure of the developer transport device 504C for cyan, the length of the intermediate transport portion 510C is less than that of the developer transport device 504K for black, and the downward transport portion 512M is arranged side-by-side with the downward transport portion 512K for black and the downward transport portion 512M for magenta. Since other structures of the developer transport device 504C are in common with those of the developer transport device 504K, detailed description thereof is omitted.

Next, the developer transport device 504Y for yellow is described. The developer transport device 504Y for yellow includes a transport portion 508Y and a downward transport portion 512Y. The developer that has just been discharged through the discharge port 44 of the developer container 40Y is transported through the transport portion 508Y. The downward transport portion 512Y is connected to the transport portion 508Y. The developing device connecting unit 524Y connected to the developing device 34Y is provided at a lower end of the downward transport portion 512Y. That is, compared to the developer transport devices 504M, 504C, and 504K for magenta, cyan, and black, the developer transport device 504Y for yellow does not include the intermediate transport portion.

Figure 7B:
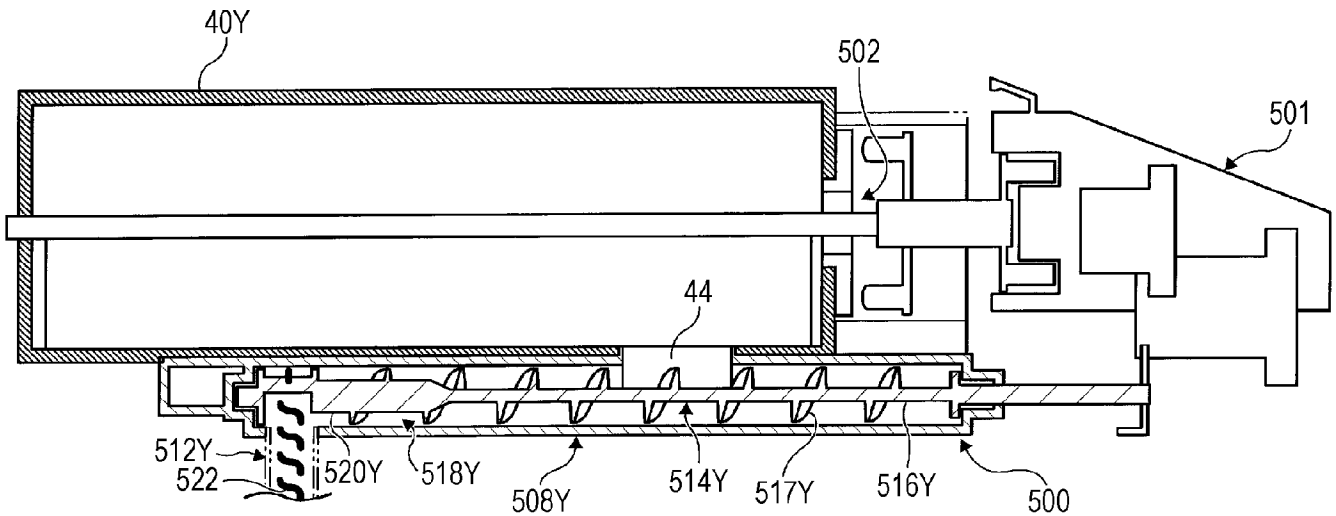
FIG. 7B is a side sectional view of a developer container for yellow and part of a developer transport device for yellow.

As illustrated in FIG. 7B, the transport portion 508Y is a hollow cylindrical body provided in the longitudinal direction of the developer container 40Y for yellow. A transport member 514Y is provided in the transport portion 508Y. The transport member 514Y includes a long rotational shaft portion 516Y and a transport body 517Y. The rotational shaft portion 516Y is provided in the longitudinal direction of the cylindrical body. The transport body 517Y is formed of a wall body helically projecting in the radial directions of this rotational shaft portion 516Y. When the transport member 514Y is rotated, the developer is transported by the helical transport body 517Y in the direction opposite to the direction in which the developer containers 40 are inserted so as to be attached to the developer container attachment device 500, that is, toward the side opposite to the output unit 14 side of the image forming apparatus body 12. Thus, the transport direction in the transport portion 508Y through which the yellow developer is transported is opposite to the transport direction in the transport portions 506M, 506C, and 506K through which the magenta, cyan, and black developers are transported.

Also, a transport amount adjustment portion 518Y is provided in the transport portion 508Y. The diameter of a rotational shaft portion 520Y of the transport member 514Y in the transport amount adjustment portion 518Y is increased compared to that of the other part of the rotational shaft portion 516Y. Thus, a space in which the developer is transported is reduced in the transport amount adjustment portion 518Y. This limits the amount of the developer to be transported by the transport member 514Y, thereby adjusting the amount of the developer to be transported.

After the developer has been transported through the transport portion 508Y, the developer is moved to the downward transport portion 512Y. As is the case with the downward transport portion 512K for black, the downward transport portion 512Y is formed of a hollow cylindrical body. A crumbling member is provided in the downward transport portion 512K. As illustrated in FIGS. 5 and 6, the downward transport portion 512Y according to the exemplary embodiment is provided so as to be vertically oriented on the one end portion side of the image forming apparatus body 12 where the developer container 40Y for yellow is disposed. Thus, transportation of the developer in the downward transport portion 512Y is performed by dropping of the developer from a top portion of the downward transport portion 512Y on the transport portion 508Y side. The downward transport portion 512Y for yellow is arranged side-by-side with the downward transport portion 512K, 512M, and 512C for black, magenta, and cyan.

Furthermore, as is the case with the above-described downward transport portion 512K for black, a crumbling member 522 is provided in the downward transport portion 512Y. The crumbling member 522 is brought into contact with the developer, thereby crumbling the developer (see FIG. 8B). The crumbling member 522 of the downward transport portion 512Y is attached to the rotational shaft portion 516Y of the transport member 514Y provided in the transport portion 508Y. Thus, part of the rotational shaft portion 516Y corresponding to the downward transport portion 512Y is made to allow the crumbling member 522 to be hooked thereon. According to the exemplary embodiment, the crumbling member 522 is hooked on the diameter-increased rotational shaft portion 520Y of the transport amount adjustment portion 518Y as illustrated in FIG. 7B. A portion of the rotational shaft portion 520Y onto which the crumbling member 522 is hooked is formed at a position shifted from the axis of the diameter-increased rotational shaft portion 520Y, so that a so-called crank shape is formed. Since the structure of the crumbling member 522 in the downward transport portion 512Y is in common with the structure of the crumbling member 522 in the downward transport portion 512K, detailed description thereof is omitted.

After the developer has been transported through the downward transport portion 512Y, the developer is moved into the developing device 34Y. This allows development to be performed by the image forming section 22Y as described above.

As has been described, the transport direction in the transport portion 508Y of the developer transport device 504Y for yellow is opposite to that in the transport portions 506M, 506C, and 506K for magenta, cyan, and black according to the exemplary embodiment. Thus, the length of a path of the developer transport devices may be reduced, and accordingly, the size of the image forming apparatus 10 may be reduced.

The transport amount adjustment portions 518Y, 518M, 518C, and 518K provided in the respective transport portion 508Y, 506M, 506C, and 506K for yellow, magenta, cyan, and black may be provided at positions separated from the discharge ports 44 of the developer containers 40Y, 40M, 40C, and 40K such that the distances between the transport amount adjustment portions 518Y, 518M, 518C, and 518K and the respective discharge ports 44 are the same (see FIGS. 7A and 7B).

Although the transport direction of the yellow developer is different from that of the magenta, cyan, and black developers according to the exemplary embodiment, this is not limiting. Depending on arrangement of the developer containers and the developing devices, the transport direction of the yellow and magenta developers may be different from that of the cyan and black developers or the transport direction of the yellow, magenta, and cyan developers may be different from that of the black developer. Furthermore, the developers may be supplied to the respective developing devices on the side where the developer container for black is disposed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of developing devices arranged side-by-side in a first direction;

a plurality of developer containers that contain developer and that have discharge ports disposed between the plurality of developing devices in the first direction; and a plurality of developer transport devices that transport the developer from the plurality of developer containers to the plurality of developing devices, wherein the plurality of developer transport devices include respective transport portions arranged side-by-side, and wherein, through at least one of the transport portions, the developer is transported from a corresponding one of the discharge ports in a direction opposite to a direction in which the developer is transported from the other discharge ports through the other transport portions.

2. The image forming apparatus according to claim 1, wherein the transport portions are each provided in a longitudinal direction of a corresponding one of the plurality of developer containers.

3. The image forming apparatus according to claim 1, wherein the developer that has just been supplied from the plurality of developer containers is transported through the transport portions, and wherein transport amount adjustment portions that adjust amounts by which the developer is transported are provided in the respective transport portions.

4. The image forming apparatus according to claim 3,

Wherein the transport amount adjustment portions are provided at positions separated by distances equal to one another from the discharge ports through which the developer is discharged from the plurality of developer containers.

5. The image forming apparatus according to claim 3, wherein, in each of the transport portions, a transport member that includes a rotational shaft portion provided in a longitudinal direction of the transport portion and a transport body formed of a helical wall body projecting in radial directions of the rotational shaft portion are provided, and the developer is transported by the transport member in accordance with rotation of the transport body, and wherein, in each of the transport amount adjustment portions, a diameter of part of the rotational shaft portion is increased relative to another part of the rotational shaft portion.

6. The image forming apparatus according to claim 1, wherein the plurality of developer transport devices include downward transport portions through which the developer is transported by dropping of the developer downward relative to the transport portions, and wherein lower end portions of the downward transport portions are connected to the plurality of developing devices.

7. The image forming apparatus according to claim 6, wherein crumbling members that crumble the developer while the developer is being transported is provided in the respective downward transport portions, and wherein the crumbling members are repeatedly moved in the downward transport portions by rotation of rotational shaft portions.

8. The image forming apparatus according to claim 6, wherein, at least one of the transport portions is directly connected to a corresponding one of the downward transport portions, and wherein the other transport portions include intermediate transport portions that connect the other transport portions to the other downward transport portions.

9. The image forming apparatus according to claim 6, wherein the downward transport portions are provided on a side where an outermost one of the plurality of developer containers is disposed.

* * * * *